US011381040B2

(12) United States Patent
Hibino

(10) Patent No.: US 11,381,040 B2
(45) Date of Patent: Jul. 5, 2022

(54) OUTER CONDUCTOR TERMINAL AND SHIELD CONNECTOR

(71) Applicant: SUMITOMO WIRING SYSTEMS, LTD., Mie (JP)

(72) Inventor: Takuma Hibino, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/982,616

(22) PCT Filed: Mar. 28, 2019

(86) PCT No.: PCT/JP2019/013725
§ 371 (c)(1),
(2) Date: Sep. 21, 2020

(87) PCT Pub. No.: WO2019/189629
PCT Pub. Date: Oct. 3, 2019

(65) Prior Publication Data

US 2021/0028584 A1 Jan. 28, 2021

(30) Foreign Application Priority Data

Mar. 29, 2018 (JP) ..... JP2018-064187

(51) Int. Cl.
*H01R 13/6594* (2011.01)
*H01R 24/50* (2011.01)
(Continued)

(52) U.S. Cl.
CPC ..... *H01R 13/6594* (2013.01); *H01R 13/40* (2013.01); *H01R 24/50* (2013.01);
(Continued)

(58) Field of Classification Search
CPC .... H01R 13/6594; H01R 13/40; H01R 24/50; H01R 9/05; H01R 12/716; H01R 12/724; H01R 43/16
See application file for complete search history.

(56) References Cited

U.S. PATENT DOCUMENTS 4,580,858 A * 4/1986 Daberkoe ..... H01R 12/724 29/760
10,566,741 B2 * 2/2020 Maesoba ..... H01R 13/648

FOREIGN PATENT DOCUMENTS

JP 2005-209423 A 8/2005
JP 2008-192474 A 8/2008
JP 2011-049118 A 3/2011

OTHER PUBLICATIONS

International Search Report dated May 14, 2019 for WO 2019/189629 A1 (4 pages).

* cited by examiner

*Primary Examiner* — Abdullah A Riyami
*Assistant Examiner* — Justin M Kratt
(74) *Attorney, Agent, or Firm* — Venjuris, P.C.

(57) ABSTRACT

An external conductor terminal (22) comprises: a terminal body (45) that can surround the outer periphery of an internal conductor terminal (21); a back plate part (43) that is displaced from an open state to a closed state in relation to the terminal body (45), and seals a back-surface opening of the terminal body (45) in the closed state; and a side plate part (44) that connects to the back plate part (43), and constitutes a part of a side-surface portion of the terminal body (45) in the closed state. The back plate part (43) has a base plate connection piece (49) that projects out toward a circuit board (90). The side plate part (44) has: a linear-shaped slit (53) that extends toward the circuit board (90); and a locking part (54) that is bent and raised through the slit
(Continued)

(53), is locked to the terminal body (45), and holds the back plate part (43) in the closed state.

10 Claims, 7 Drawing Sheets

(51) Int. Cl.

| | |
|---|---|
| ***H01R 13/40*** | (2006.01) |
| *H01R 9/05* | (2006.01) |
| *H01R 12/71* | (2011.01) |
| *H01R 12/72* | (2011.01) |
| *H01R 43/16* | (2006.01) |

(52) U.S. Cl.
CPC ..... *H01R 9/05* (2013.01); *H01R 12/716* (2013.01); *H01R 12/724* (2013.01); *H01R 43/16* (2013.01)

OUTER CONDUCTOR TERMINAL AND SHIELD CONNECTOR

TECHNICAL FIELD

The present invention relates to an outer conductor terminal and a shield connector.

BACKGROUND

Patent Document 1 discloses a shield terminal with an inner conductor terminal, an outer conductor terminal surrounding the outer periphery of the inner conductor terminal and a dielectric interposed between the outer conductor terminal and the inner conductor terminal. Patent Document 1 also discloses a shield connector with the shield terminal and a connector housing for accommodating the shield terminal. The outer conductor terminal is composed of an outer conductor terminal body for covering the inner conductor terminal, and a lid body for covering a back surface side of the outer conductor terminal body. The outer conductor terminal body includes base plate assembly tabs projecting downward on four corners. The lid body is fit to a rear part of the outer conductor terminal body from outside.

PRIOR ART DOCUMENT

Patent Document

Patent Document 1: JP 2008-192474A

SUMMARY OF THE INVENTION

Problems to be Solved

In the above case, a special lock structure is not provided between the lid body and the outer conductor terminal body. However, a lock structure is preferably provided to ensure further reliability in retaining the shape of the outer conductor terminal. Such a structure that the lid body is formed with a U-shaped slit, an inner part of the slit is bent inward to form a projection and the outer conductor terminal body is formed with a locking edge to be locked to the projection with the outer conductor terminal body covered with the lid body is, for example, considered as a lock structure of this type.

However, a return current in response to an electrical signal transmitted by the inner conductor terminal is generated in the outer conductor terminal and flows to a ground pattern of a circuit board via the base plate assembly tabs. Thus, a path of the return current may be blocked by the U-shaped slit formed in the lid body. If the return current flows to an outer surface side (surface side) of the outer conductor terminal through the U-shaped slit, a problem occurs in which the return current becomes a new noise source.

The present invention was completed on the basis of the above situation and aims to provide an outer conductor terminal capable of ensuring a good shielding property and a shield connector using the outer conductor terminal.

Means to Solve the Problem

The present invention is directed to an outer conductor terminal with a terminal body capable of surrounding an outer periphery of an inner conductor terminal, a back plate portion for closing a back surface opening of the terminal body in a closed state by being displaced from an open state to the closed state with respect to the terminal body, and a side plate portion connected to the back plate portion, the side plate portion constituting a part of a side surface part of the terminal body in the closed state, wherein the back plate portion includes a board connecting piece projecting toward a circuit board and to be electrically connected to the circuit board, and the side plate portion includes a linear slit extending toward the circuit board and a locking portion bent via the slit, the locking portion holding the back plate portion in the closed state by locking the body portion.

Effect of the Invention

Since both the board connecting piece of the back plate portion and the slit of the side plate portion are formed to extend toward the circuit board, it can be prevented that a path of a return current flowing to a ground pattern of the circuit board through the board connecting piece is blocked by the slit, and the leakage of the return current to an outer surface side of the outer conductor terminal through the slit can be hindered. As a result, noise can be reliably emitted to the ground pattern and good shielding performance can be exhibited.

DETAILED DESCRIPTION TO EXECUTE THE INVENTION

Preferred embodiments of the present invention are described below.

(1) The board connecting piece is capable of contacting along a surface of the circuit board. If the board connecting piece is for surface mounting in this way, assemblability with the circuit board can be improved. Further, since the board connecting piece is provided on the back plate portion, a part capable of contacting along the surface of the circuit board can be easily formed by bending.

(2) A shield connector using the outer conductor terminal having the above configuration is provided with a shield terminal including the outer conductor terminal, the inner conductor terminal and a dielectric interposed between the outer conductor terminal and the inner conductor terminal, and a connector housing for accommodating the shield terminal. According to the above configuration, a good shielding property can be realized, wherefore this shield connector is suitably used, for example, as a shield connector for high speed communication of an automotive vehicle.

Embodiment

Figure 2:
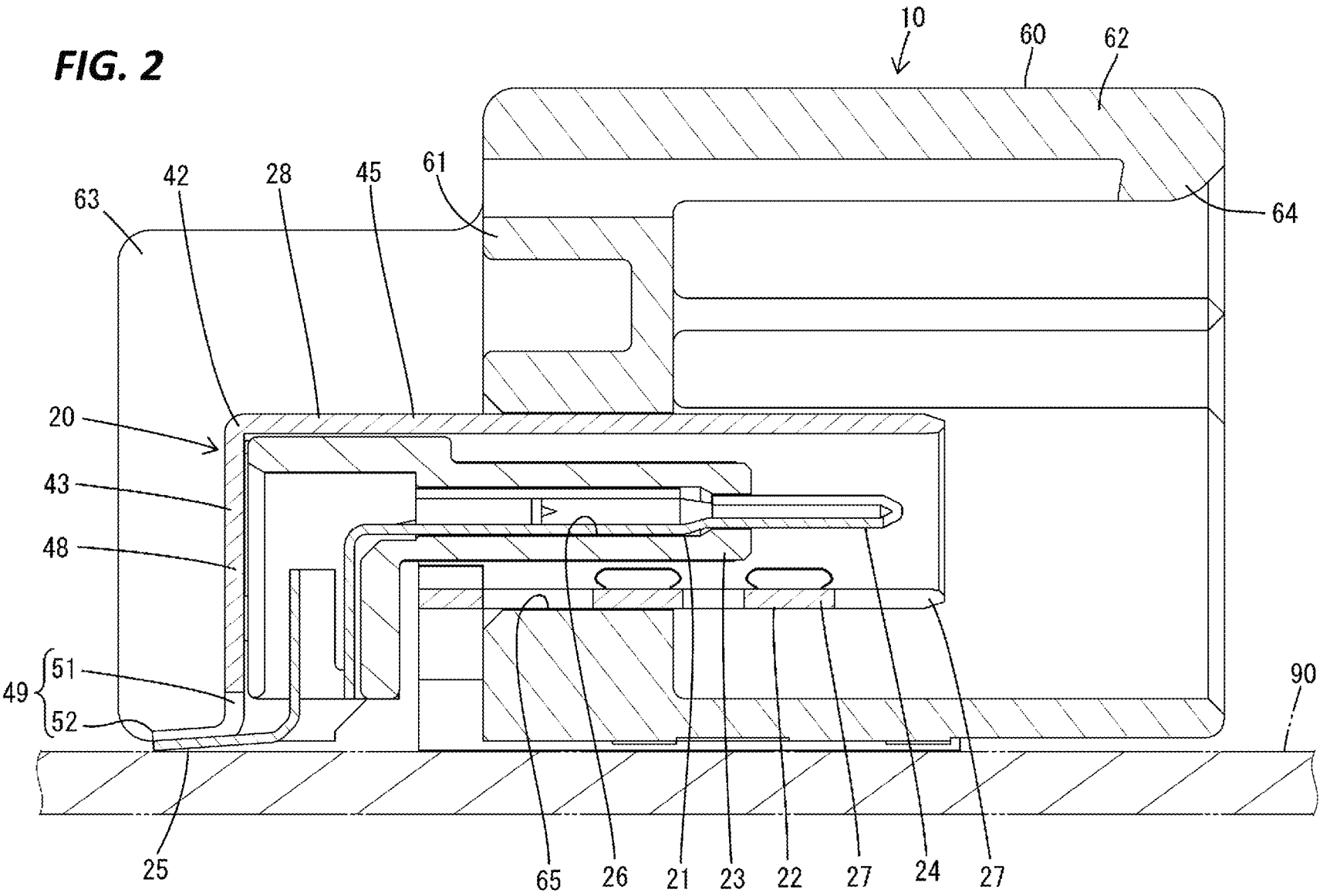
FIG. 2 is a section along A-A of FIG. 1.

Hereinafter, one embodiment is described with reference to the drawings. A shield connector 10 mounted in an unillustrated vehicle such as an electric or hybrid vehicle and used for high speed communication between in-vehicle electrical components is shown in this embodiment. This shield connector 10 is mounted on a surface of a circuit board 90 as shown in FIG. 2. Note that, in the following description, a right side of FIG. 2 is referred to as a front side concerning a front-rear direction, and upper and lower sides are based on a vertical direction of FIG. 2.

As shown in FIG. 2, the shield connector 10 includes a shield terminal 20 and a connector housing 60 for accommodating the shield terminal 20. The shield terminal 20 includes an inner conductor terminal 21, an outer conductor terminal 22 surrounding the outer periphery of the inner conductor terminal 21 and a dielectric 23 interposed between the outer conductor terminal 22 and the inner conductor terminal 21.

The inner conductor terminal 21 is formed, such as by bending a conductive metal plate. The inner conductor terminal 21 includes a tab 24 projecting forward. The tab 24 is electrically connected to an unillustrated mating terminal fitting provided in a mating connector when the shield connector 10 is connected to the unillustrated mating connector. The inner conductor terminal 21 includes one connecting piece 25 bent downward at an intermediate position in a length direction and further extending rearward from a lower end part. The connecting piece 25 is in contact with and electrically connected to a conductive pattern (conductive path) for signal transmission formed on the surface of the circuit board 90.

The dielectric 23 is made of an insulating synthetic resin material having a predetermined relative permittivity and includes a terminal accommodation chamber 26 penetrating in the front-rear direction inside. The inner conductor terminal 21 is accommodated in the terminal accommodation chamber 26. The inner conductor terminal 21 is held in the dielectric 23 with the tab 24 projecting forward from a front end opening of the terminal accommodation chamber 26. The inner conductor terminal 21 and the outer conductor terminal 22 are kept insulated from each other by the dielectric 23.

The outer conductor terminal 22 is formed, such as by bending a conductive metal plate. The outer conductor terminal 22 is composed of a tubular portion 27 penetrating in the front-rear direction and a back unit 28 arranged behind the tubular portion 27. A specific structure of the outer conductor terminal 22 is described in detail later.

Figure 1:
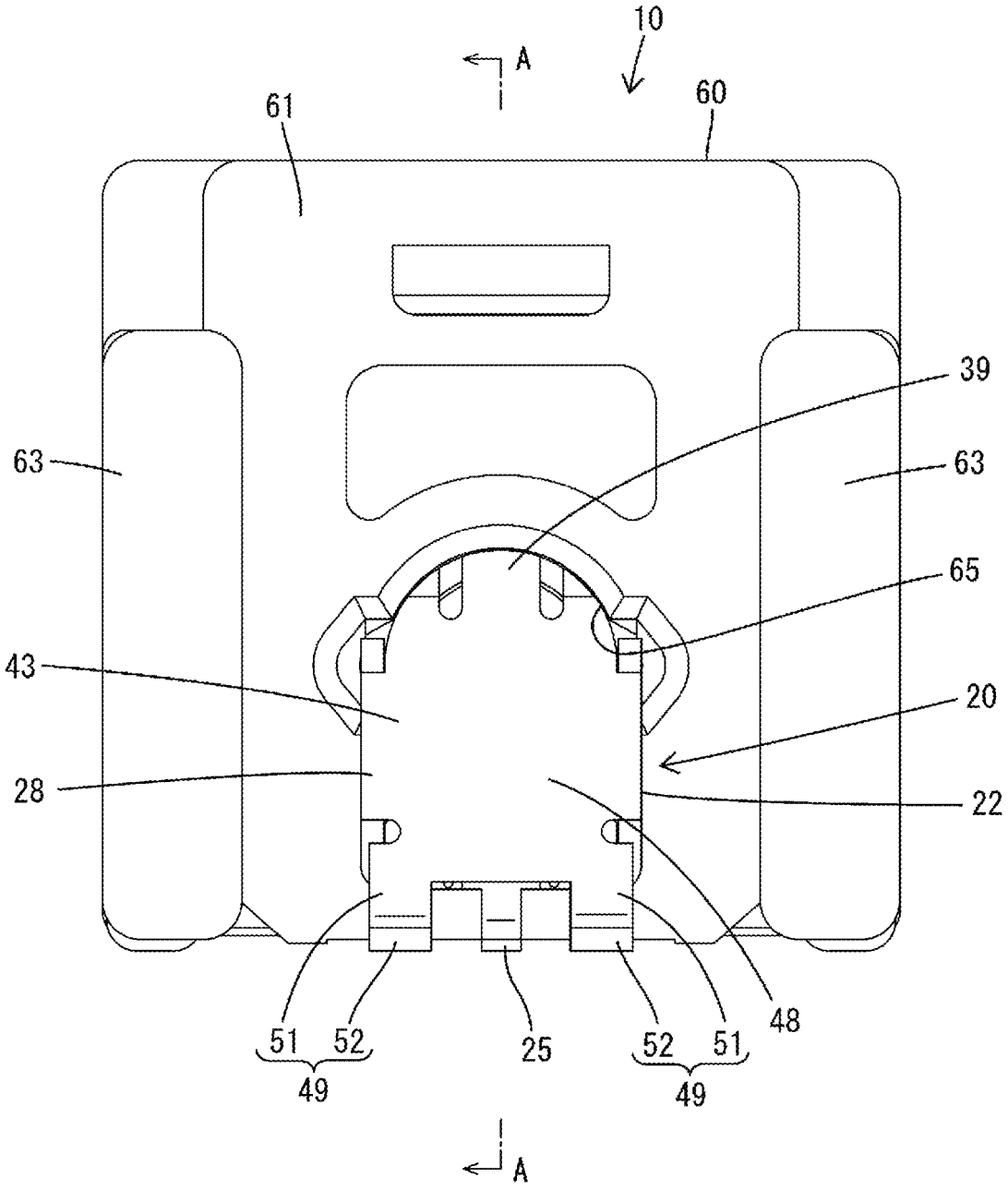
FIG. 1 is a back view of a shield connector according to one embodiment of the present invention.

The connector housing 60 is made of synthetic resin and includes, as shown in FIG. 2, a base wall portion 61 substantially in the form of a rectangular plate substantially extending along the vertical direction and a receptacle 62 substantially in the form of a rectangular tube projecting forward from the outer peripheral edge of the base wall portion 61. As shown in FIG. 1, the connector housing 60 includes a pair of side wall portions 63 projecting rearward from both left and right ends of the base wall portion 61.

As shown in FIG. 2, the receptacle 62 includes a housing lock portion 64 on the inner surface of an upper wall. An unillustrated mating connector is fit into the receptacle 62. The housing lock portion 64 functions to lock the mating connector in the receptacle 62 and hold the both connectors in a connected state.

The base wall portion 61 includes a mounting hole 65 having a substantially circular cross-section and penetrating in the front-rear direction (wall thickness direction) at a position slightly below a vertical center in a lateral center. The tubular portion 27 of the outer conductor terminal 22 is inserted into the mounting hole 65 of the base wall portion 61. The outer conductor terminal 22 is mounted into the connector housing 60 with a front part of the tubular portion 27 projecting into the receptacle 62 and the back unit 28 exposed behind the base wall portion 61 (see FIG. 1). A part of the outer conductor terminal 22 exposed behind the base wall portion 61 has both left and right sides covered and protected by the side wall portions 63.

Figure 4:
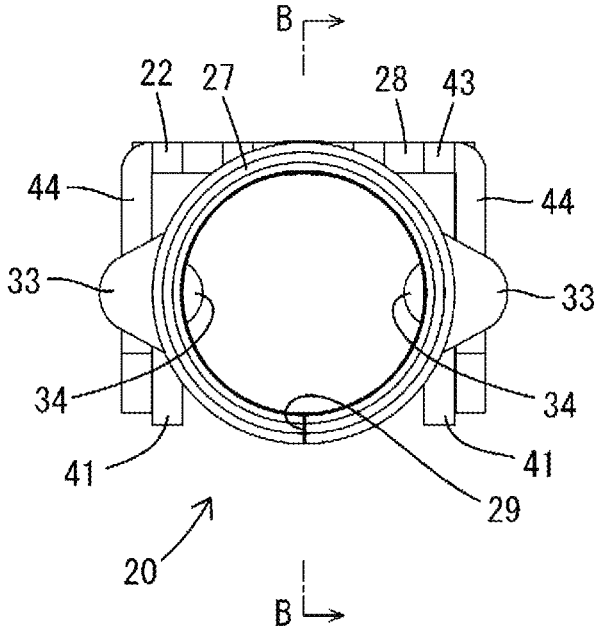
FIG. 4 is a front view of the outer conductor terminal in the open state.
Figure 6:
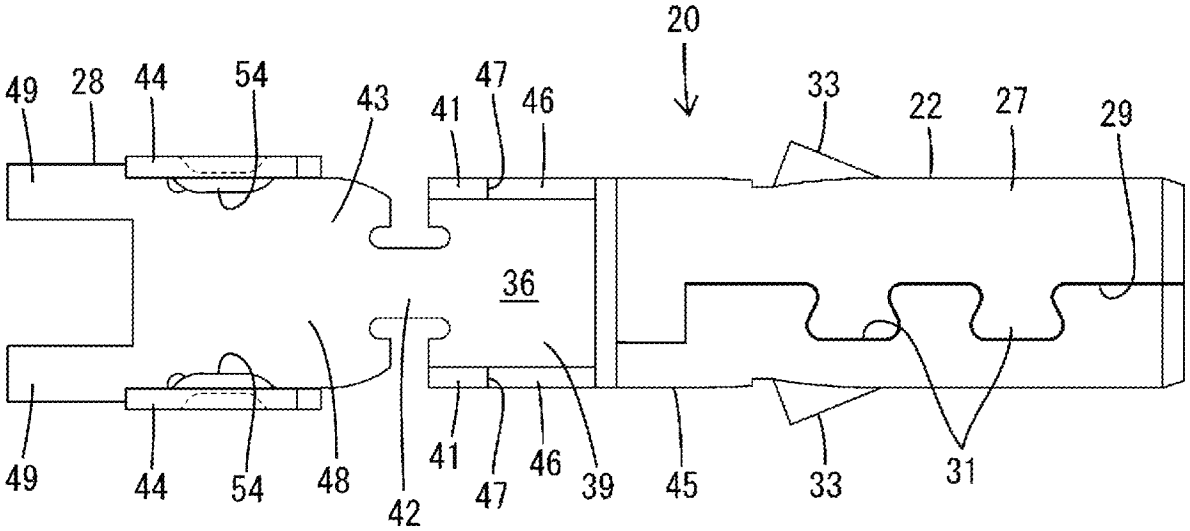
FIG. 6 is a bottom view of the outer conductor terminal in the open state.

The tubular portion 27 of the outer conductor terminal 22 has a circular tube shape (tube shape having a circular cross-section) and includes, as shown in FIGS. 4 and 6, butting ends 29 in a lateral center of a lower end. The butting ends 29 of the tubular portion 27 are provided with projections and recesses 31 arranged in the front-rear direction. The tubular portion 27 is maintained in the circular tube shape by the engagement of the projections and recesses 31.

Figure 3:
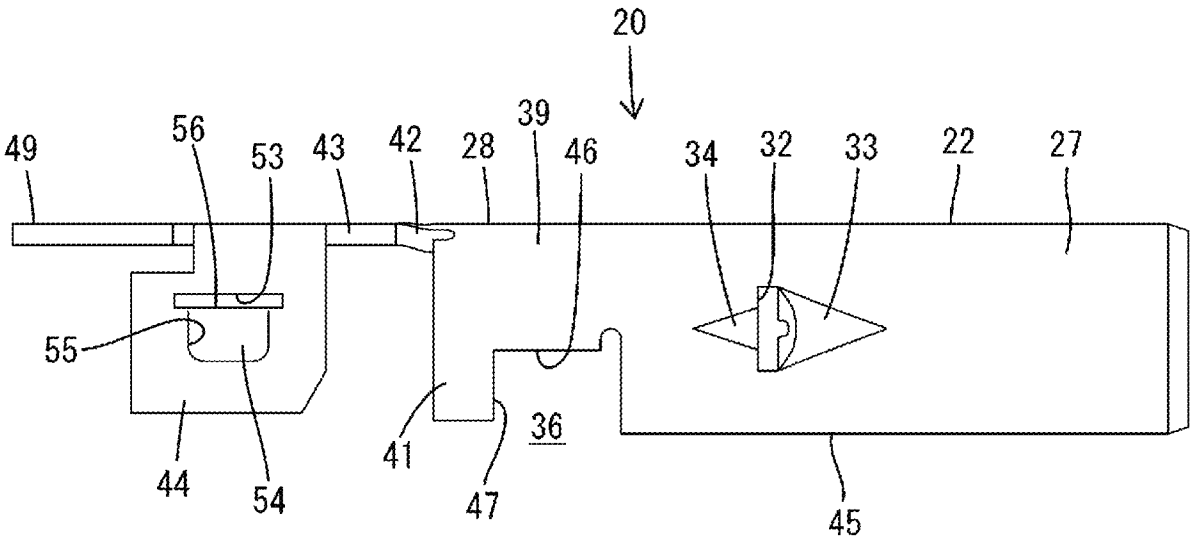
FIG. 3 is a side view of an outer conductor terminal in an open state.
Figure 5:
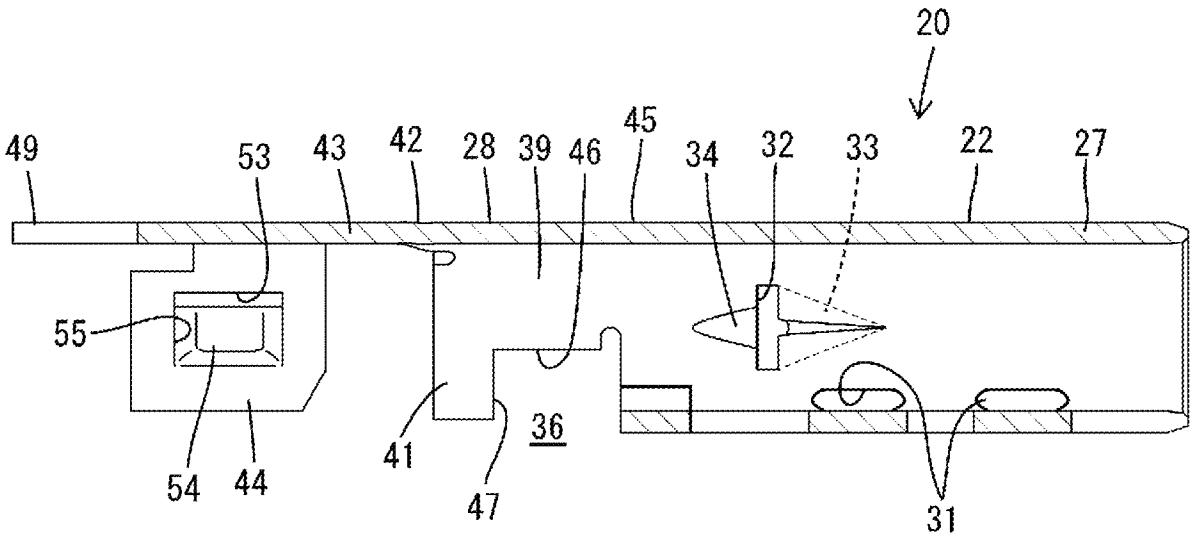
FIG. 5 is a section along B-B of FIG. 4.

As shown in FIGS. 3 and 5, the tubular portion 27 includes a pair of body-side slits 31 (only one is shown) linearly (along one straight line) open along the vertical direction in vertical centers of both left and right sides, and a pair of outer locking portions 33 for the connector housing 60 on front sides and a pair of inner locking portions 34 for the dielectric 23 on rear sides, out of both front and rear sides across the both body-side slits 32. The both outer locking portions 33 are formed by bending side wall parts of the tubular portion 27 outward via the body-side slits 32 and in the form of claws substantially triangular in a side view. The both outer locking portions 33 lock the base wall portion 61, whereby the outer conductor terminal 22 penetrating through the mounting hole 65 is held and fixed in the connector housing 60. The both inner locking portions 34 are formed by bending side wall parts of the tubular portion 27 inward via the body-side slits 32 (see FIG. 4) and in the form of claws substantially triangular in a side view. The inner locking portions 34 are shaped to be one size smaller than the outer locking portions 33. The both inner locking portions 34 lock the dielectric 23, whereby the dielectric 23 is held and fixed in the tubular portion 27.

As shown in FIGS. 3, 5 and 6, the back unit 28 includes a coupling portion 39 having a semicircular cross-section and projecting rearward while being connected to an upper half of the tubular portion 27 without any step, lock receiving portions 41 connected to the lower end of the coupling portion 39, a fulcrum portion 42 connected to a lateral center (also an upper end) of the rear end of the coupling portion 39, a back plate portion 43 connected to the fulcrum portion 42 on a side opposite to the coupling portion 39 and a pair of side plate portions 44 connected to both left and right ends of the back plate portion 43. A terminal body 45 is constituted by a part of the outer conductor terminal 22 composed of the tubular portion 27, the coupling portion 39 and the lock receiving portions 41 (excluding the fulcrum portion 42, the back plate portion 43 and the side plate portions 44).

A space below the coupling portion 39 and the lock receiving portions 41 and behind the tubular portion 27 serves as a space portion 36 which is open downward and rearward when the back plate portion 43 is in an open state and is open downward when the back plate portion 43 is in a closed state.

As shown in FIGS. 4 and 6, a pair of the lock receiving portions 41 are shaped to project on both circumferential ends, i.e. lower ends, of the coupling portion 39. Each of the both lock receiving portions 41 is in the form of a plate rectangular in a side view and connected to a rear part of the lower end of the coupling portion 39 and hangs down from the coupling portion 39. The back unit 28 (also the terminal body 45) is formed with substantially right-angled steps 46 facing the space portion 36 from the lower ends of the coupling portion 39 to the front ends of the lock receiving portions 41. The both lock receiving portions 41 include lock receiving edges 47 extending along the vertical direction on front ends.

As shown in FIG. 6, the fulcrum portion 42 is a narrow flexible hinge located between the coupling portion 39 and the back plate portion 43 and linking the both.

The back plate portion 43 is rotationally displaceable via the fulcrum portion 42 with respect to the coupling portion 39 to the open state (see FIGS. 3 to 6) in which the fulcrum portion 42 extends straight and is arranged substantially horizontally and to the closed state (see FIGS. 1, 2 and 7) in which the fulcrum portion 42 is turned and bent and arranged substantially perpendicularly. As shown in FIG. 1, the back plate portion 43 includes a back plate body 48 rectangular in a back view and capable of covering a rear surface opening of the terminal body 45 in the closed state and a pair of strip-like board connecting pieces 49 projecting from both left and right ends of the lower edge (end edge on a lower side in the closed state) of the back plate body 48.

Figure 7:
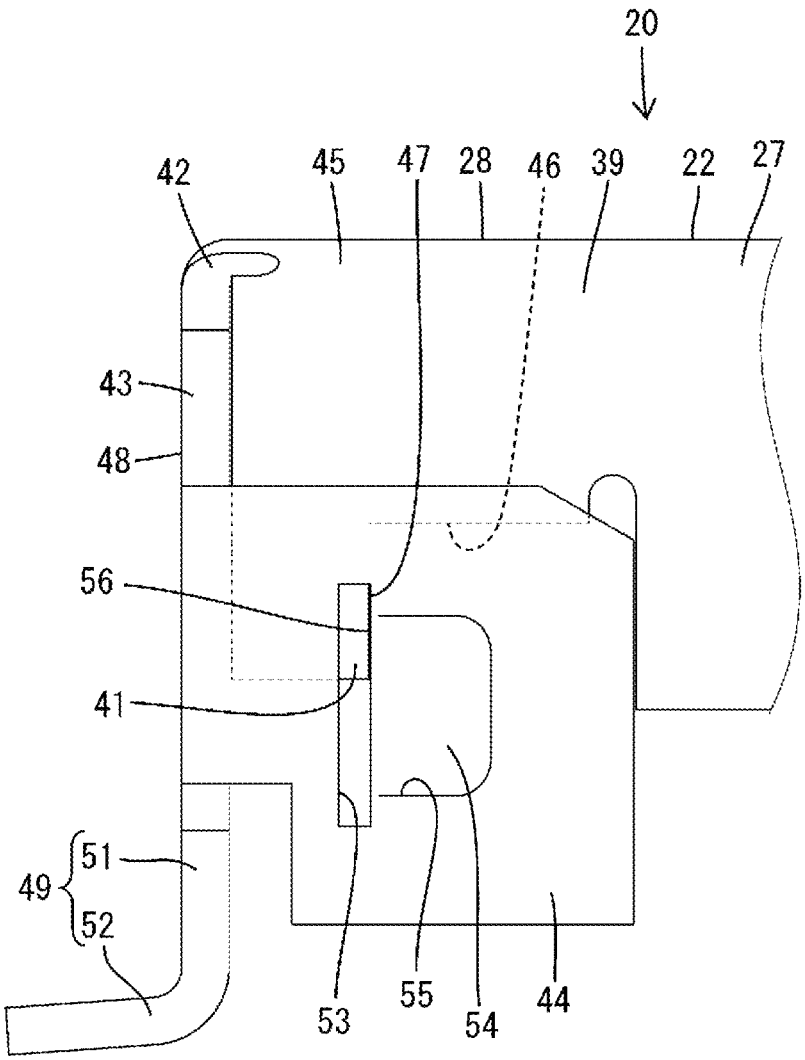
FIG. 7 is a partial enlarged side view of the outer conductor terminal in a closed state.

As shown in FIGS. 2 and 7, each of the both board connecting pieces 49 is bent into a substantially L shape in a side view, thereby including a connecting base end part 51 hanging down from the back plate body 48 toward the circuit board 90 along the vertical direction in the closed state and a connecting tip part 52 (surface contact portion) bent at the lower end of the connecting base end part 51 to extend rearward. The connecting tip parts 52 are electrically connected to a ground pattern formed on the surface of the circuit board 90.

As shown in FIG. 7, the both side plate portions 44 are in the form of plates substantially rectangular in a side view and connected substantially at a right angle to both left and right ends of the back plate portion 43, and project forward from the both left and right ends of the back plate portion 43 in the closed state. When the back plate portion 43 is in the closed state, the upper ends of the both side plate portions 44 are arranged along the lower ends of the coupling portion 39 and respectively cover the corresponding lock receiving portions 41 from outside.

As shown in FIG. 7, each of the both side plate portions 44 includes a slit 53 linearly (along a straight line) open along the vertical direction in the closed state substantially in a central part and a locking portion 54 for the lock receiving portion 41 on a front side, out of both front and rear sides across the slit 53. Each of the both locking portions 54 is bent inward via the slit 53 and formed into a flat trapezoidal shape bulging from a substantially U-shaped peripheral edge part 55 having a front edge and upper and lower edges located in front of the slit 53 (see FIGS. 5 and 6). The both locking portions 54 include locking edges 56 extending along the vertical direction on rear ends, which are also front edges of cuts of the slits 53.

Next, functions and effects of this embodiment are described.

When the back plate portion 43 is in the open state, the dielectric 23 carrying the inner conductor terminal 21 is inserted into the outer conductor terminal 22. Subsequently, the back plate portion 43 is rotationally displaced from the open state to the closed state via the fulcrum portion 42. In the process of displacing the back plate portion 43 to the closed state, the locking portions 54 of the both side plate portions 44 interfere with the corresponding lock receiving portions 41 and the both side plate portions 44 are expanded and deformed (resiliently deformed) with parts coupled to the back plate portion 43 as fulcrums.

When the back plate portion 43 reaches the closed state, a back surface opening of the terminal body 45 is closed by the back plate portion 43 and the both resiliently returned side plate portions 44 cover the entire corresponding lock receiving portions 41 from outside to constitute parts of side surface parts of the terminal body 45. Further, the locking portions 54 of the both side plate portions 44 lock the corresponding lock receiving portions 41 and the locking edges 56 of the locking portions 54 come into contact with the lock receiving edges 47 of the lock receiving portions 41 (see FIG. 7). In this way, a return displacement of the back plate portion 43 to the open state is prevented and, eventually, the outer conductor terminal 22 is maintained in a box shape.

When the back plate portion 43 is in the closed state, front end lower parts of the lock receiving portions 41 are facing upper parts of the slits 53 of the side plate portions 44 and the front ends of the side plate portions 44 are vertically arranged along the rear end of the tubular portion 27 in a side view.

Subsequently, the outer conductor terminal 22 is inserted into the mounting hole 65 of the base wall portion 61 of the shield connector 10 to be assembled. Thereafter, the shield connector 10 is disposed on the surface of the circuit board 90. In this way, the connecting piece 25 is conductively connected to a conductive pattern formed on the surface of the circuit board 90 and the connecting tip parts 52 of the both board connecting pieces 49 are conductively connected to the ground pattern formed on the surface of the circuit board 90. Here, the both board connecting pieces 49 are arranged at both left and right sides of the connecting piece 25 (see FIG. 1).

If an electrical signal flows in the inner conductor terminal 21, a return current in response to the electrical signal is generated in the outer conductor terminal 22. The return current flows from the coupling portion 39 to the circuit board 90 through the back plate portion 43 along the inner surface of the outer conductor terminal 22, and is dropped to the ground pattern of the circuit board 90 via the both board connecting pieces 49.

In this case, the slits 53 formed as the locking portions 54 are bent linearly extend along the vertical direction, which is a flowing direction of the return current toward the circuit board 90, similarly to the connecting base end parts 51 of the both board connecting pieces 49. Thus, the slits 53 do not substantially impede the flow of the return current. Further, if the slits 53 are shaped to linearly extend in the vertical direction, the leakage of the return current to the outer surface side of the outer conductor terminal 22 can be reduced and noise emitted to the outside of the shield connector 10 can also be reduced.

As described above, since the both board connecting pieces 49 of the back plate portion 43 and the slits 53 of the both side plate portions 44 are all formed to extend toward the circuit board 90 according to this embodiment, it can be prevented that a path of the return current is blocked by the slits 53 when the return current flows to the ground pattern of the circuit board 90 through the both board connecting pieces 49 and the leakage of the return current to the outer surface side of the outer conductor terminal 22 through the slits 53 can be hindered. As a result, noise can be reliably discharged to ground and good shielding performance can be exhibited.

Further, since the board connecting pieces 49 are for surface mounting by including the connecting tip parts 52 capable of contacting along the surface of the circuit board 90, assemblability with the circuit board 90 can be improved. Further, since the board connecting pieces 49 are provided on the back plate portion 43, the connecting tip parts 52 of the board connecting pieces 49 can be easily formed by bending.

Other Embodiments

Other embodiments are briefly described below.

(1) The tubular portion of the outer conductor terminal may be in the form of a rectangular tube. Further, the tubular portion may be shaped to be open on the circuit board side.

(2) The number of the board connecting pieces is arbitrary. One, three or more board connecting pieces may be provided.

(3) The back plate portion may be constituted by a separate member removable from the terminal body.

(4) The board connecting pieces may be of a through hole type that are formed along the vertical direction as a whole and inserted into through holes of the circuit board to be connected.

LIST OF REFERENCE NUMERALS

10 . . . shield connector
20 . . . shield terminal
21 . . . inner conductor terminal
22 . . . outer conductor terminal
23 . . . dielectric
27 . . . tubular portion
43 . . . back plate portion
44 . . . side plate portion
45 . . . terminal body
49 . . . board connecting piece
54 . . . locking portion
60 . . . connector housing
90 . . . circuit board

What is claimed is:

1. An outer conductor terminal, comprising:

a terminal body capable of surrounding an outer periphery of an inner conductor terminal;

a back plate portion for closing a back surface opening of the terminal body in a closed state by being displaced from an open state to the closed state with respect to the terminal body; and a side plate portion connected to the back plate portion, the side plate portion constituting a part of a side surface part of the terminal body in the closed state, wherein:

the back plate portion includes a board connecting piece projecting toward a circuit board and to be electrically connected to the circuit board, the side plate portion includes a linear slit extending toward the circuit board in the closed state and a locking portion bent via the slit, the locking portion holding the back plate portion in the closed state by locking the terminal body, and the locking portion is formed into a flat trapezoidal shape bulging from a substantially U-shaped peripheral edge part having a front edge and upper and lower edges located in front of the slit.

2. The outer conductor terminal of claim 1, wherein the board connecting piece is capable of contacting along a surface of the circuit board.

3. A shield connector using the outer conductor terminal of claim 1, comprising:

a shield terminal including the outer conductor terminal, the inner conductor terminal and a dielectric interposed between the outer conductor terminal and the inner conductor terminal; and a connector housing for accommodating the shield terminal.

4. The outer conductor terminal of claim 1, wherein the board connecting piece is conductively connected to a ground pattern formed on a surface of the circuit board.

5. The outer conductor terminal of claim 1, wherein the locking portion is formed at a front side of the slit with respect to the back plate portion.

6. An outer conductor terminal, comprising:

a terminal body capable of surrounding an outer periphery of an inner conductor terminal;

a back plate portion for closing a back surface opening of the terminal body in a closed state by being displaced from an open state to the closed state with respect to the terminal body; and a side plate portion connected to the back plate portion, the side plate portion constituting a part of a side surface part of the terminal body in the closed state, wherein:

the back plate portion includes a board connecting piece projecting toward a circuit board and to be electrically connected to the circuit board, the side plate portion includes a linear slit extending toward the circuit board in the closed state and a locking portion bent via the slit, the locking portion holding the back plate portion in the closed state by locking the terminal body, and the locking portion includes locking edges extending along a vertical direction on rear ends, which are also front edges of cuts of the slit.

7. The outer conductor terminal of claim 6, wherein the board connecting piece is capable of contacting along a surface of the circuit board.

8. A shield connector using the outer conductor terminal of claim 6, comprising:

a shield terminal including the outer conductor terminal, the inner conductor terminal and a dielectric interposed between the outer conductor terminal and the inner conductor terminal; and a connector housing for accommodating the shield terminal.

9. The outer conductor terminal of claim 6, wherein the board connecting piece is conductively connected to a ground pattern formed on a surface of the circuit board.

10. The outer conductor terminal of claim 6, wherein the locking portion is formed at a front side of the slit with respect to the back plate portion.

* * * * *